US008228280B2

(12) United States Patent
Usui et al.

(10) Patent No.: US 8,228,280 B2
(45) Date of Patent: Jul. 24, 2012

(54) TIMING CONTROL CIRCUIT

(75) Inventors: Hirotoshi Usui, Kyoto (JP); Seiji Tokumasu, Kyoto (JP)

(73) Assignee: Rohm Co., Ltd. (JP)

( * ) Notice: Subject to any disclaimer, the term of this patent is extended or adjusted under 35 U.S.C. 154(b) by 310 days.

(21) Appl. No.: 12/574,359

(22) Filed: Oct. 6, 2009

(65) Prior Publication Data

US 2010/0085392 A1 Apr. 8, 2010

(30) Foreign Application Priority Data

Oct. 6, 2008 (JP) ..... 2008-260064

(51) Int. Cl.
*G09G 3/36* (2006.01)

(52) U.S. Cl. ..... 345/99; 345/87; 345/204; 345/691

(58) Field of Classification Search ..... 345/76, 345/79, 87–100, 204, 214, 691
See application file for complete search history.

(56) References Cited

U.S. PATENT DOCUMENTS 6,657,622 B2 * 12/2003 Park ..... 345/205
7,640,371 B2 * 12/2009 Odamura ..... 710/14
7,746,317 B2 * 6/2010 Fu et al. ..... 345/102
8,044,915 B2 * 10/2011 Honda et al. ..... 345/99
2005/0168428 A1 * 8/2005 Nakajima et al. ..... 345/99
2009/0189836 A1 * 7/2009 Hu ..... 345/87

FOREIGN PATENT DOCUMENTS

JP 6-273788 A 9/1994
JP 2003-173150 A 6/2003

* cited by examiner

*Primary Examiner* — Nitin Patel
*Assistant Examiner* — Mansour M Said
(74) *Attorney, Agent, or Firm* — Cantor Colburn LLP

(57) ABSTRACT

A reception interface circuit receives a luminance signal for each of multiple colors and a clock signal as input signals. A timing control unit receives the luminance signals received by the reception interface circuit, and controls the timing and format thereof such that they match drivers. A transmission interface circuit transmits the signals generated by the timing controller IC to the drivers. The timing controller IC is included within a rectangular package as a built-in component. The reception interface circuit is arranged on a first short side of the package. The transmission interface circuit is arranged on a second short side of the package. The image data is input via input terminals arranged on the first short side. The output signals of the transmission interface circuit are output via output terminals arranged on the second short side.

2 Claims, 3 Drawing Sheets

TIMING CONTROL CIRCUIT

BACKGROUND OF THE INVENTION

1. Field of the Invention

The present invention relates to a timing control circuit which supplies driving signals to a driver for a liquid crystal panel.

2. Description of the Related Art

In general, a laptop PC (Personal Computer) includes a casing mounting a processor and a casing mounting a liquid crystal panel connected to each other via a movable structure such as a hinge member or the like. FIGS. 1A and 1B show a configuration of an ordinary laptop PC. It should be noted that the size of the components in the drawings may be enlarged or reduced, and the shape thereof modified, as appropriate. A PC 300 includes a first casing 310 and a second casing 320 connected to each other via a hinge structure or the like. The first casing 310 mounts a keyboard, a CPU (Central Processing Unit), a USB (Universal Serial Bus) interface, and so forth, which are not shown, in addition to a processor (graphic chip) 312 which generates image data. The second casing 320 mounts a liquid crystal panel 322, a gate driver 324, a source driver 326, in addition to a backlight and a driver circuit (inverter) thereof, which are not shown.

The image data generated by the processor 312 is transmitted by a transmission chip 314 to the second casing 320 side via a bus formed on an FPC (flexible printed circuit) provided within the movable structure 330 such as a hinge member. The second casing 320 includes a timing controller IC 328 which receives the image data from the transmission chip 314, and which performs timing control operation, and which converts the image data thus received into a data format suitable for the gate driver and the source driver.

[Related Art Documents]

[Patent Documents]

[Patent Document 1]

Japanese Patent Application Laid Open No. H6-273788

[Patent Document 2]

Japanese Patent Application Laid Open No. 2003-173150

As shown in FIG. 1B, the timing controller IC 328 is mounted on a printed-circuit board 329. The printed-circuit board 329 mounts peripheral circuit components for the timing controller IC 328. In addition, an input-side wiring bus BUS1 and an output-side wiring bus BUS2 are formed on the printed-circuit board 329. The input bus BUS1 receives image data from the transmission chip 314 via a connector 325. In conventional techniques, a configuration is made in which the data transmitted from the transmission chip 314 is input from the side of the printed-circuit board 329 opposite to the liquid crystal panel 322, and is output via the side thereof facing the liquid crystal panel 322. Accordingly, such an arrangement requires the printed-circuit board 329 to have a great width d due to the bus BUS1, the BUS2, and a mounting area 327 for mounting circuit components. The printed-circuit board 329 having such a great size occupies a great part of the second casing 320, leading to a difficulty in providing the second casing 320 with a reduced size. Such a problem can occur in electronic devices other than the laptop PC as well.

SUMMARY OF THE INVENTION

The present invention has been made in order to solve such a problem. Accordingly, it is an exemplary purpose of the present invention to provide a reduced-size device including a liquid crystal panel.

An embodiment of the present invention relates to a timing control circuit which receives image data to be output to a liquid crystal panel and outputs the image data to a driver for the liquid crystal panel. The timing control circuit comprises: a reception interface circuit which receives a luminance signal for each of multiple colors and a clock signal; a timing control unit which receives the luminance signals received by the reception interface circuit, and controls the timing and format thereof such that they match the driver; a transmission interface circuit which transmits signals generated by the timing control unit to the driver. With such an embodiment, the timing control circuit is included within a rectangular package as a built-in component. Furthermore, the reception interface circuit is arranged on a first short side of the package. Moreover, the transmission interface circuit is arranged on a second short side of the package which is opposite to the first short side of the package. With such an arrangement, image data is input via input terminals arranged on the first short side of the package. Furthermore, output signals of the transmission interface circuit are output via output terminals arranged on the second short side of the package.

With such an embodiment, the image data is input from the first short side of the rectangular package, passes through the interior thereof, and is output from the second short side thereof which is opposite to the first short side thereof. Such an arrangement does not require a bus extending from a long side of the rectangular package for transmitting the data to the driver. Thus, a board for mounting the semiconductor device can be formed with reduced width, thereby providing an electronic device with a reduced size.

Another embodiment of the present invention relates to a display apparatus. The display apparatus comprises: a liquid crystal panel; a gate driver and a source driver which drive the liquid crystal panel; a printed-circuit board arranged along one side of the liquid crystal panel; a connector mounted on the printed-circuit board, via which a cable for transmitting image data to be displayed on the liquid crystal panel is detachably connected; the aforementioned timing control circuit mounted on the printed-circuit board; an input bus which is formed on the printed-circuit board, and which connects the connector and input terminals arranged on the first short side of the timing control circuit; and an output bus which is formed on the printed-circuit board, and which connects output terminals arranged on the second short side of the timing control circuit to the gate driver and the source driver. With such an embodiment, the input bus is formed on the first short side on the printed-circuit board. Furthermore, the output bus is formed on the second short side on the printed-circuit board.

Yet another embodiment of the present invention relates to an electronic device. The electronic device comprises a first casing and a second casing connected to each other via a movable structure. With such an embodiment, the first casing comprises: a processor which generates image data to be displayed on a liquid crystal panel; and a transmission circuit which transmits the image data. Furthermore, the second casing comprises: a liquid crystal panel; a gate driver and a source driver which drive the liquid crystal panel; a printed-circuit board arranged along one side of the liquid crystal panel; a connector mounted on the printed-circuit board, via which a cable for transmitting image data to be displayed on the liquid crystal panel is detachably connected; the aforementioned timing control circuit mounted on the printed-circuit board; an input bus which is formed on the printed-circuit board, and which connects the connector to input terminals arranged on the first short side of the timing control circuit; and an output bus which is formed on the printed-circuit board, and which connects output terminals arranged on the second short side of the timing control circuit to the gate driver and the source driver. With such an arrangement, the input bus is formed on the first short side on the printed-circuit board. Furthermore, the output bus is formed on the second short side on the printed-circuit board.

It is to be noted that any arbitrary combination or rearrangement of the above-described structural components and so forth is effective as and encompassed by the present embodiments.

Moreover, this summary of the invention does not necessarily describe all necessary features so that the invention may also be a sub-combination of these described features.

BRIEF DESCRIPTION OF THE DRAWINGS

Embodiments will now be described, by way of example only, with reference to the accompanying drawings which are meant to be exemplary, not limiting, and wherein like elements are numbered alike in several FIGURES, in which.

DETAILED DESCRIPTION OF THE INVENTION

The invention will now be described based on preferred embodiments which do not intend to limit the scope of the present invention but exemplify the invention. All of the features and the combinations thereof described in the embodiment are not necessarily essential to the invention.

Figure 1A:
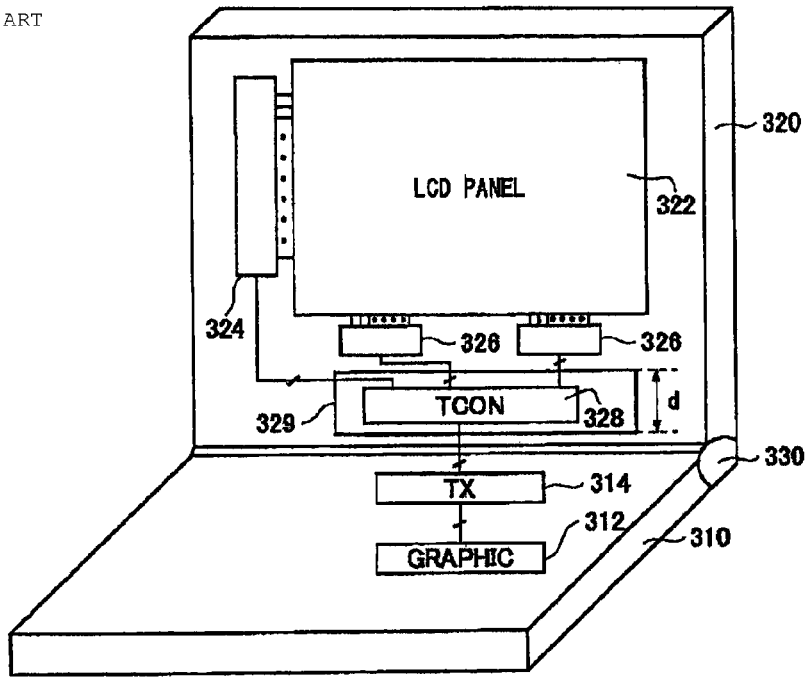
FIG.1A PRIOR ART
FIGS. 1A and 1B are diagrams which show the configuration of an ordinary laptop PC.
Figure 1B:
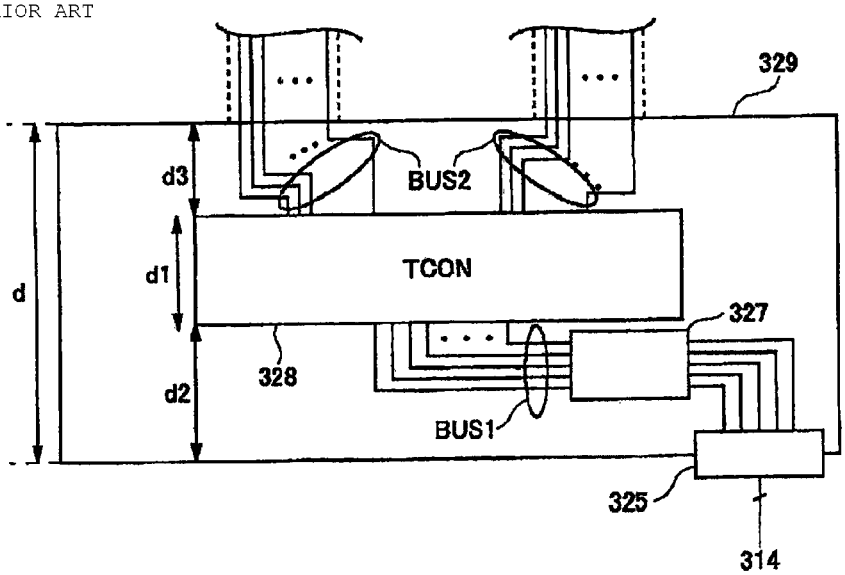
FIG.1B PRIOR ART
Figure 2:
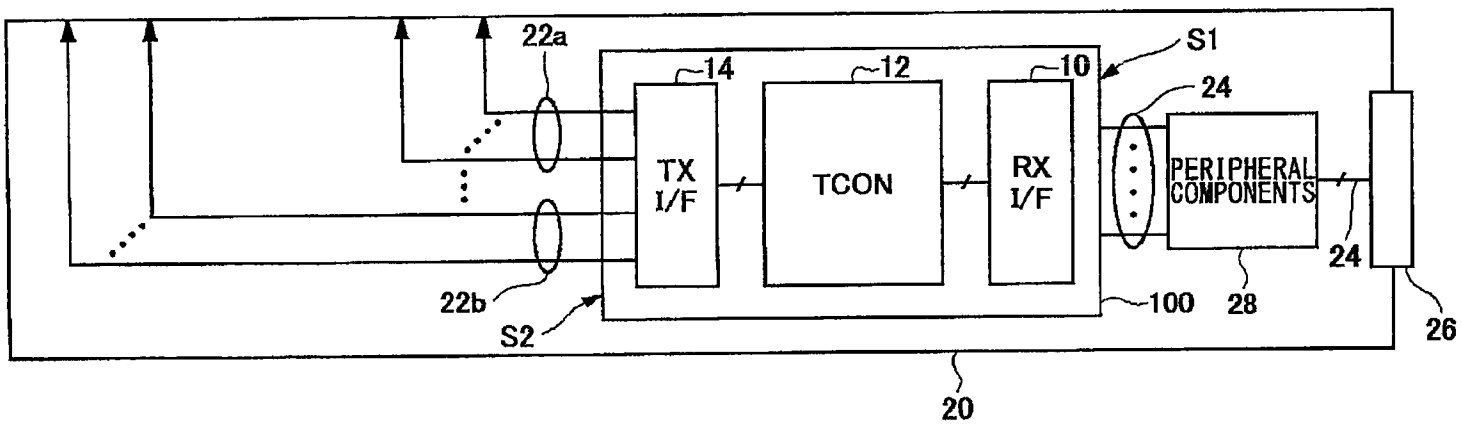
FIG. 2 is a diagram which shows a timing controller IC and a peripheral circuit thereof according to an embodiment.

FIG. 2 is a diagram which shows a timing controller IC (which will also be referred to as "control IC") 100 and a peripheral circuit thereof. The timing controller IC 100 has the same function as that of the timing controller IC 328 shown in FIG. 1, and accordingly, description of the function will be simplified.

The timing controller IC 100 receives, from a processor, the image data to be output to a liquid crystal panel (not shown), and performs predetermined signal processing as necessary, examples of which include scaling processing, interlacing processing, and non-interlacing processing. Furthermore, the timing controller IC 100 outputs a driving signal at a suitable timing to multiple gate drivers and multiple source drivers.

The timing controller IC 100 includes a reception interface circuit 10, a timing control unit 12, and a transmission interface circuit 14, and is included within a rectangular package as a build-in component. The timing controller IC 100 preferably has a BGA (Ball Grid Array) structure. The timing controller IC 100 includes back-face electrodes (terminals) arranged in the form of a matrix on the back face thereof.

The reception interface circuit 10 receives, from the processor, a luminance signal for each color and a clock signal as input signals. Each input signal is input in the form of a differential signal such as LDVS (Low Voltage Differential Signaling or the like).

The timing control unit 12 receives the luminance signal received by the reception interface circuit 10, and controls the timing and format thereof such that they match the multiple source drivers (not shown) and multiple gate drivers (not shown).

The transmission interface circuit 14 transmits the signals thus generated by the timing control unit 12 to the gate drivers and the source drivers.

The reception interface circuit 10 is arranged on a first short side S1 of the package. The transmission interface circuit 14 is arranged on a second short side S2 of the package, which is opposite to the first short side thereof. The image data received from the processor is input via terminals arranged on the first short side S1 of the package. The image data is transmitted through the interior of the printed-circuit board 20 in the horizontal direction. The output signals of the transmission interface circuit 14 are output via the terminals arranged on the short side S2 of the package.

The timing controller IC 100 is mounted on the printed-circuit board 20. The printed-circuit board 20 is arranged in the vicinity of and along one side of the liquid crystal panel (not shown). A connector 26 is mounted on the printed-circuit board 20, via which a cable for transmitting the image data to be displayed on the liquid crystal panel can be detachably connected. The connector 26 is arranged on the outer edge of the printed-circuit board 20 such that it is positioned in parallel with the first short side S1 of the timing controller IC 100.

The input bus 24 is formed on the printed-circuit board 20, which connects the connector 26 and the input terminals (back-face electrodes) provided on the short side S1 of the timing controller IC 100.

The connector 26 may be provided in parallel with the long side of the timing controller IC 100. In this case, the input bus 24 is formed in the shape of an L-shaped curve.

The output buses 22*a*, 22*b*, and so forth, are formed on the printed-circuit board 20, which respectively connect the output terminals arranged on the second short side S2 of the timing controller IC 100 to the gate drivers and the source drivers. Each of the output buses 22*a*, 22*b*, and so forth, includes multiple lines. The number of the output buses 22 matches the number of the gate drivers and the source drivers which are output destinations.

The input bus 24 is formed in a region adjacent to the first short side S1 on the printed-circuit board 20. The output buses 22 are formed in a region adjacent to the second short side S2 on the printed-circuit board 20.

The peripheral circuit components of the timing controller IC 100 are mounted in a region 28 adjacent to the first short side S1.

The above is the configuration of the periphery of the timing controller IC 100 according to the embodiment. With the timing controller IC 100 according to the embodiment, the image data is input from the first short side S1, and is output via the second short side S2. Thus, such an arrangement does not require wiring lines extending from the long side of the timing controller IC 100 on the printed-circuit board 20, or at the least reduces the number of such wiring lines. Thus, such an arrangement provides the printed-circuit board 20 with a reduced width as compared with the conventional printed-circuit board 20 shown in FIG. 1B.

For example, let us suppose an arrangement shown in FIG. 1B in which the input bus BUS1 includes ten wiring lines and the output bus BUS2 includes ten wiring lines. Furthermore, let us assume that each wiring line has a width of 0.1 mm, and the wiring lines are arranged at intervals of 0.1 mm. Such an arrangement requires an area occupied by the wiring lines on the input side of the timing controller IC 328, i.e., an area calculated by the following expression: 10×0.1 mm, and an area occupied by the spaces each of which is introduced between the adjacent wiring lines, i.e., an area calculated by the following expression: (10−1)×0.1 mm. In all, such an arrangement requires a space having a width d2=(10×0.1 mm)+(9×0.1 mm)=1.9 mm. In the same way, such an arrangement requires a space of a width d3=1.9 mm on the output side. Accordingly, such an arrangement requires the printed-circuit board 329 to have a greater width than the width of the timing controller IC 328 by 3.8 mm or more.

On the other hand, with the timing controller IC 100 shown in FIG. 2, the input bus 24 and the output buses 22 are formed such that they extend from the short sides of the timing controller IC 100. Such an arrangement reduces the number of the wiring lines extending in the vertical direction, which allows the printed-circuit board 20 to be formed with a width d closer to the width d1 of the timing controller IC 100. Specifically, such an arrangement reduces the width d of the printed-circuit board 20 by 3.8 mm as compared with an arrangement shown in FIG. 1B. The reduced area of the printed-circuit board 20 enables a set mounting the printed-circuit board 20 to be formed with a reduced size. Furthermore, such an arrangement provides the printed-circuit board 20 with low costs.

Figure 3B:
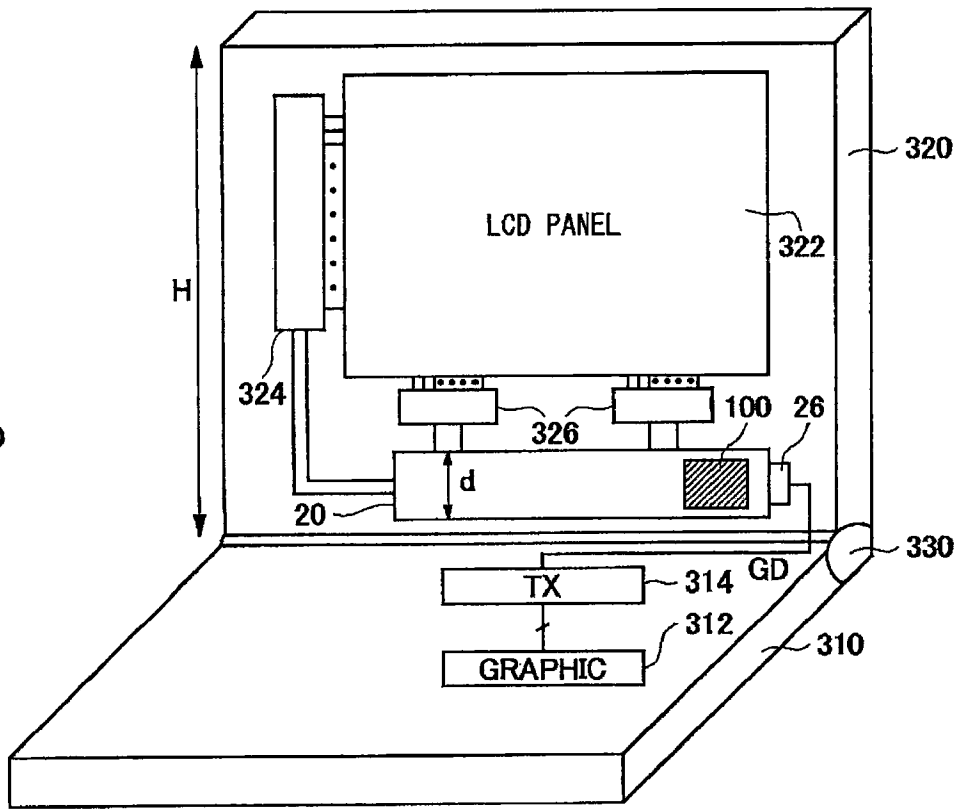
FIGS. 3A and 3B are diagrams which show the configurations of a display apparatus and an electronic device employing the timing controller shown in FIG. 2.
Figure 3A:
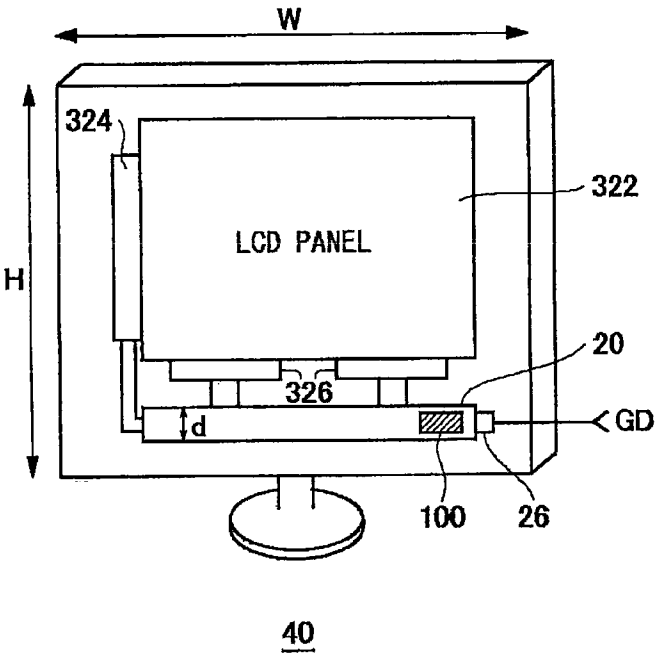

FIGS. 3A and 3B are diagrams which show the configurations of a display apparatus and an electronic device employing a timing controller IC 100 shown in FIG. 2.

A display apparatus 40 shown in FIG. 3A is a liquid crystal display or a liquid crystal TV. The display apparatus 40 includes: the liquid crystal panel 322; the gate drivers 324 and the source drivers 326 which drive the liquid crystal panel 322; and a printed-circuit board 20 arranged along one side of the liquid crystal panel 322. The printed-circuit board 20 includes the connector 26 thereon, via which a cable for transmitting image data GD to be displayed on the liquid crystal panel 322 can be detachably connected. Furthermore, the printed-circuit board 20 mounts the timing controller IC 100 shown in FIG. 2 thereon.

The printed-circuit board 20 is arranged along one of the sides of the liquid crystal panel 322. In a case in which the printed-circuit board 20 is arranged below the liquid crystal panel 322 as shown in FIG. 3A, the casing of the display apparatus 40 can be formed with a reduced height H due to the reduced width d of the printed-circuit board 20. In a case in which the printed-circuit board 20 is arranged along either the left side or the right side of the liquid crystal panel 322, the casing of the display apparatus 40 can be formed with a reduced width W due to the reduced width d of the printed-circuit board 20.

The electronic device 50 shown in FIG. 3B is a laptop (notebook) PC, for example. The electronic device 50 includes the first casing 310 and the second casing 320 connected to each other via the movable structure 330. The electronic device 50 shown in FIG. 3B has basically the same configuration as that of the PC 300 shown in FIG. 1A.

With the electronic device 50 shown in FIG. 3B, the width d of the printed-circuit board 20 is smaller than that of the printed-circuit board 329 shown in FIG. 1B, thereby providing the second casing 320 with a reduced size.

While the preferred embodiments of the present invention have been described using specific terms, such description is for illustrative purposes only, and it is to be understood that changes and variations may be made without departing from the spirit or scope of the appended claims.

What is claimed is:

1. A display apparatus comprising:

a liquid crystal panel;

a gate driver and a source driver which drive the liquid crystal panel;

a printed-circuit board arranged along one side of the liquid crystal panel;

a connector mounted on the printed-circuit board, via which a cable for transmitting image data to be displayed on the liquid crystal panel is detachably connected;

a timing control circuit mounted on the printed-circuit board, configured to receive the image data and to output the image data to the gate driver and the source driver, the timing control circuit comprising:

a reception interface circuit which receives a luminance signal for each of multiple colors and a clock signal;

a timing control unit which receives the luminance signals received by the reception interface circuit, and controls the timing and format thereof such that they match the driver;

a transmission interface circuit which transmits signals generated by the timing control unit to the driver, the timing control circuit being included within a rectangular package, the rectangular package having a first short side and a second short side opposite to the first short side, as a built-in component, the reception interface circuit being arranged on the first short side, the transmission interface circuit being arranged on the second short side, the image data being input via input terminals arranged on the first short side, output signals of the transmission interface circuit being output via output terminals arranged on the second short side;

an input bus which is formed on the printed-circuit board, and which connects the connector and input terminals arranged on the first short side of the timing control circuit; and an output bus which is formed on the printed-circuit board, and which connects output terminals arranged on the second short side of the timing control circuit to the gate driver and the source driver, wherein the input bus is formed on the first short side on the printed-circuit board, and wherein the output bus is formed on the second short side on the printed-circuit board.

2. An electronic device comprising a first casing and a second casing connected to each other via a movable structure, wherein the first casing comprises:

a processor which generates image data to be displayed on a liquid crystal panel; and a transmission circuit which transmits the image data, and wherein the second casing comprises a liquid crystal panel, a gate driver and a source driver which drive the liquid crystal panel, a printed-circuit board arranged along one side of the liquid crystal panel, a connector mounted on the printed-circuit board, via which a cable for transmitting image data to be displayed on the liquid crystal panel is detachably connected, a timing control circuit mounted on the printed-circuit board, configured to receive the image data and to output the image data to the gate driver and the source driver, the timing control circuit comprising:

a reception interface circuit which receives a luminance signal for each of multiple colors and a clock signal;

a timing control unit which receives the luminance signals received by the reception interface circuit, and controls the timing and format thereof such that they match the driver;

a transmission interface circuit which transmits signals generated by the timing control unit to the driver, the timing control circuit being included within a rectangular package, the rectangular package having a first short side and a second short side opposite to the first short side, as a built-in-component, the reception interface circuit being arranged on the first short side, the transmission interface circuit being arranged on the second short side. the image data being input via input terminals arranged on the first short side, output signals of the transmission interface circuit being output via output terminals arranged on the second short side, an input bus which is formed on the printed-circuit board, and which connects the connector and an reception interface circuit arranged on the first short side of the timing control circuit, and an output bus which is formed on the printed-circuit board, and which connects a transmission interface circuit arranged on the second short side of the timing control circuit to the gate driver and the source driver, wherein the input bus is formed on the first short side on the printed-circuit board, and wherein the output bus is formed on the second short side on the printed-circuit board.

* * * * *